United States Patent [19]

Kinosz et al.

[11] 4,160,715

[45] Jul. 10, 1979

[54] ELECTROLYTIC FURNACE LINING

[75] Inventors: Donald L. Kinosz, Arnold, Pa.; William R. Allen, Maryville, Tenn.

[73] Assignee: Aluminum Company of America, Pittsburgh, Pa.

[21] Appl. No.: 919,771

[22] Filed: Jun. 28, 1978

[51] Int. Cl.[2] ..... C25C 3/08; C25C 3/06

[52] U.S. Cl. ..... 204/243 R; 204/67

[58] Field of Search ..... 204/243 R, 243 M, 244–247, 204/67

[56] References Cited

U.S. PATENT DOCUMENTS

| | | | |
|---|---|---|---|
| 3,856,650 | 12/1974 | Kugler et al. | 204/243 R |
| 3,960,696 | 6/1976 | Wittner | 204/245 |
| 4,093,524 | 6/1978 | Payne | 204/243 R |
| 4,118,304 | 10/1978 | Arita | 204/243 R |

FOREIGN PATENT DOCUMENTS

| | | | |
|---|---|---|---|
| 324293 | 2/1972 | U.S.S.R. | 204/243 R |

*Primary Examiner*—F. C. Edmundson
*Assistant Examiner*—D. R. Valentine
*Attorney, Agent, or Firm*—David J. Hill

[57] ABSTRACT

An improved lining for an electrolytic furnace for producing aluminum is disclosed having sufficient thickness that heat flow therethrough is such that an insulative coating provided on the inside surface of a perimetric metal shell around the electrolytic furnace is not exposed to temperatures above an upper temperature limit at which the coating is impenetrable by molten salt. Such improved lining includes an inner layer of high-fired refractory, penetrable by the molten salt and resistant to chemical corrosion by such penetration. The inner layer is of sufficient thickness that a salt freeze line is located therein. Within the inner layer and outside the freeze line is a layer of material impenetrable by molten aluminum. In at least the bottom portion of the furnace and outside the inner layer is at least one layer of glass refractory impermeable to the molten salt.

11 Claims, 4 Drawing Figures

GRAPHITE

HIGH FIRED REFRACTORY

GLASS REFRACTORY

ELECTROLYTIC FURNACE LINING

BACKGROUND OF THE INVENTION

1. Field of the Invention

The present invention relates to the construction for an electrolytic furnace, and more particularly to an improved lining for an electrolytic furnace used to produce aluminum from aluminum chloride dissolved in molten salts of higher electrodecomposition potential.

2. Description of the Art

Electrolytic production of light metals is disclosed generally by Haupin in U.S. Pat. No. 3,755,099 as a process performed in a furnace or cell which includes at least two opposed electrodes providing at least one interelectrode space therebetween. More particularly, such cell includes an anode, at least one intermediate bipolar electrode and a cathode in superimposed, spaced relationship defining a plurality of interelectrode spaces therebetween. In such process a light metal chloride, such as aluminum chloride, is dissolved in a bath of molten salts having higher electrodecomposition potential than the light metal chloride. The bath is preferably maintained above the liquidus temperature of the light metal being produced. In the operation of the cell, chlorine is produced on the anode surface, and light metal, such as aluminum, is produced on the cathode surface. The process also provides for the maintenance of bath flow through each interelectrode space.

Although the lining disclosed in the present specification is partially directed to a furnace used for the production of aluminum from aluminum chloride, it is intended to be equally applicable to furnaces used to produce other metals from their metal chlorides, including magnesium from magnesium chloride, zinc from zinc chloride and lead from lead chloride.

A typical composition in weight percent for the bath in a cell from which aluminum may be produced by electrolysis is made up of about 51% sodium chloride (NaCl), about 40% lithium chloride (LiCl), about 6.5% aluminum chloride ($AlCl_3$) and about 2.5% magnesium chloride ($MgCl_2$). Other chlorides may be regarded as incidental components or impurities. Such bath is maintained in a molten state at a temperature above the melting temperature of aluminum of 660° C.

A primary problem attendant the economic commercial production of aluminum by the electrolytic process described above is to contain the high temperature, corrosive bath constituents without detrimentally cooling the interior portions of the furnace. This problem is two-fold as it involves containment of not only the molten salt, but also the molten metal produced in the cell.

It has been found that the corrosive bath constituents react with certain cell lining materials and thereby cause bath contamination and, perhaps, premature consumption of the anodes. For example, silicon from silica-based refractories tends to contaminate the molten aluminum being produced. Also, refractories having high oxygen values may cause a reaction with carbon in the anodes to produce carbon monoxide and carbon dioxide, while consuming the anodes. Jacobs in U.S. Pat. No. 3,785,941 discloses the use of nitride-based refractory which does not react with the salts to corrode the refractory or contaminate the bath. Those skilled in the art also recognize the high cost involved in using such alternative refractory materials.

The majority of the molten aluminum formed in the cell is contained in a carbonaceous sump located in the lower portion of the cell. This sump is usually made of graphite which resists attack and penetration by molten aluminum. Portions of the molten aluminum, however, penetrate the sump or the interstices within the sump, and proceed into the refractory lining. Such penetration occurs primarily in the bottom or floor of the cell where the driving force is gravity. If the molten aluminum penetrates unimpeded through the refractory lining to the metal shell, at least a portion of the electrical system will short circuit. It is therefore desirable to stop the flow of molten aluminum through the refractory lining of an electrolysis cell to optimize production and energy efficiency thereof by preventing the possibility of short circuiting caused as a result of molten metal penetration.

The molten salt in the cell is continuously circulating through the cell, usually at temperatures approximating 700° C. There is no known economically feasible material in the class of an insulating refractory that is impervious to such high temperature molten salt bath and is able to withstand molten metal attack. Therefore, the desired approach has been to utilize materials in the hot, inner layers of electrolysis cell linings that resist chemical corrosion when penetrated by the molten salts and the molten metal. It is well understood that, as the salts permeate the refractory lining of a cell, heat loss increases. At lower temperatures certain materials can be employed in the outer layers that better resist molten salt attack. For example, Russell et al in U.S. Pat. Nos. 3,773,643 and 3,779,699 teach that lower temperature molten salt penetration is inhibited by a layer of glass, such as window glass.

There are inorganic rigid glass foam materials that are not only impervious to lower temperatures molten salts but also exhibit thermal conductivities and thermal shock resistance that render these materials ideal for use in electrolysis cell linings. It will be understood that such materials can be constructed with higher or lower upper use temperature limitations with higher and lower cost, respectively. In an electrolysis cell lining, the greater thermal protection is required in the inner layers, while less thermal protection is required in the outer layers where pentrating salts have experienced heat loss.

Although certain materials are impervious to salt penetration at certain temperatures, such materials are constructed in brick or block form and laid in the lining. A portion of the molten salts readily flows through the seam or interface between adjacent bricks and proceeds outwardly toward adjacent layers of refractory. Also, although the salts experience significant heat loss as they penetrate the cell lining, and although the majority of the salt freezes within the lining, certain eutectics are formed with the aluminum chloride, for example, which have melting points less than about 100° C. and are, therefore, highly penetrable.

Since the metal shell surrounding the cell exhibits a temperature that may be in excess of about 100° C., at least a portion of the molten salts is not solidified or frozen within the lining. In any event, the salts must not be permitted to contact the metallic shell, otherwise chlorine is evolved at such anodic locations or aluminum is evolved at cathodic locations. The chlorine at anodic locations could decompose the steel shell. At the side walls, which are usually water cooled, coolant could flow through such holes into the cell.

U.S. Patent No. 4,140,595 of Russell et al, discloses the use of electrically insulative coatings on the inside surface of the metal shell which prevent molten salts at relatively low temperatures from penetrating therethrough and contacting the shell. Such coatings may be natural or synthetic rubber, asphalt or synthetic plastic, including polytetrafluoroethylene, silicone resins or epoxy resins. Since such coating materials are resistant to molten salts at low temperatures, it is important that the amount of salt reaching the coating area be reduced, and that the temperature of such penetrating salt be reduced below such temperature limit.

Thermal balance is critical in designing a lining for an electrolytic cell. The lining must not degrade to assure that the temperatures at any location within the cell lining remain substantially constant throughout the operation of the cell. In determining such balance it is imperative to consider salt penetration which usually raises the thermal conductivity of the penetrated refractory. Salt penetration, therefore, should be held relatively stable throughout the operation of the cell so as not to upset the established thermal balance. To assure stability and thermal balance, design parameters should be such that salt and metal penetration is controlled and that the lining does not degrade throughout the campaign of the cell.

Accordingly, an improved, economical lining is desired for an electrolytic cell which will minimize bath contamination and anode consumption and maximize the life of the furnace lining by maintaining a stable thermal balance therethrough.

SUMMARY OF THE INVENTION

This invention may be summarized as providing an improved lining for an electrolytic furnace. The lining of the present invention is of sufficient thickness that heat flow therethrough is such that an insulative coating provided on the inside surface of a perimetric metal shell around the electrolytic furnace is not exposed to temperatures above an upper temperature limit at which the coating is impenetrable by molten salt. Such improved lining includes an inner layer of high-fired refractory, penetrable by the molten salt and resistant to chemical corrosion by such penetration. The inner layer is of sufficient thickness that a salt freeze line is located therein. Within the inner layer and outside the freeze line is a layer of material impenetrable by molten aluminum. In at least the bottom portion of the furnace and outside the inner layer is at least one layer of glass refractory impermeable to the molten salt.

A primary advantage of the lining of the present invention is its increased life which permits uninterrupted and continuous production of aluminum while decreasing the overall costs of cell linings as based on units of production, i.e. dollars per ton of aluminum.

Another advantage of the lining of the present invention is that salt and metal penetration therein is controlled such that a predetermined and uniform heat flow is maintained in the cell lining throughout the life of the lining. As used herein, "heat flow" refers to the process by which heat is conducted from one molecule to another in the direction of a colder zone. By uniformly controlling bath penetration and maintaining heat flow, the cell is operated efficiently and economically, especially with regard to production rates and electrical efficiency.

It follows that an advantage of the lining of the present invention is that temperature limitations, especially the temperature of the molten metal in the sump and the heat at the shell of the cell are maintained.

An objective of the present invention is to utilize a unique combination of refractory materials to provide a cell lining which resists not only electrolytic attack by a molten salt bath but also attack by molten metal penetration.

Another primary objective of the lining of this invention is to control metal penetration therethrough by providing at a particular location within the lining a layer of material that is fully impenetrable by the molten metal.

The above and other objectives and advantages will be more adequately understood and appreciated with reference to the following description and the drawings appended hereto.

DESCRIPTION OF THE PREFERRED EMBODIMENTS

Figure 1:
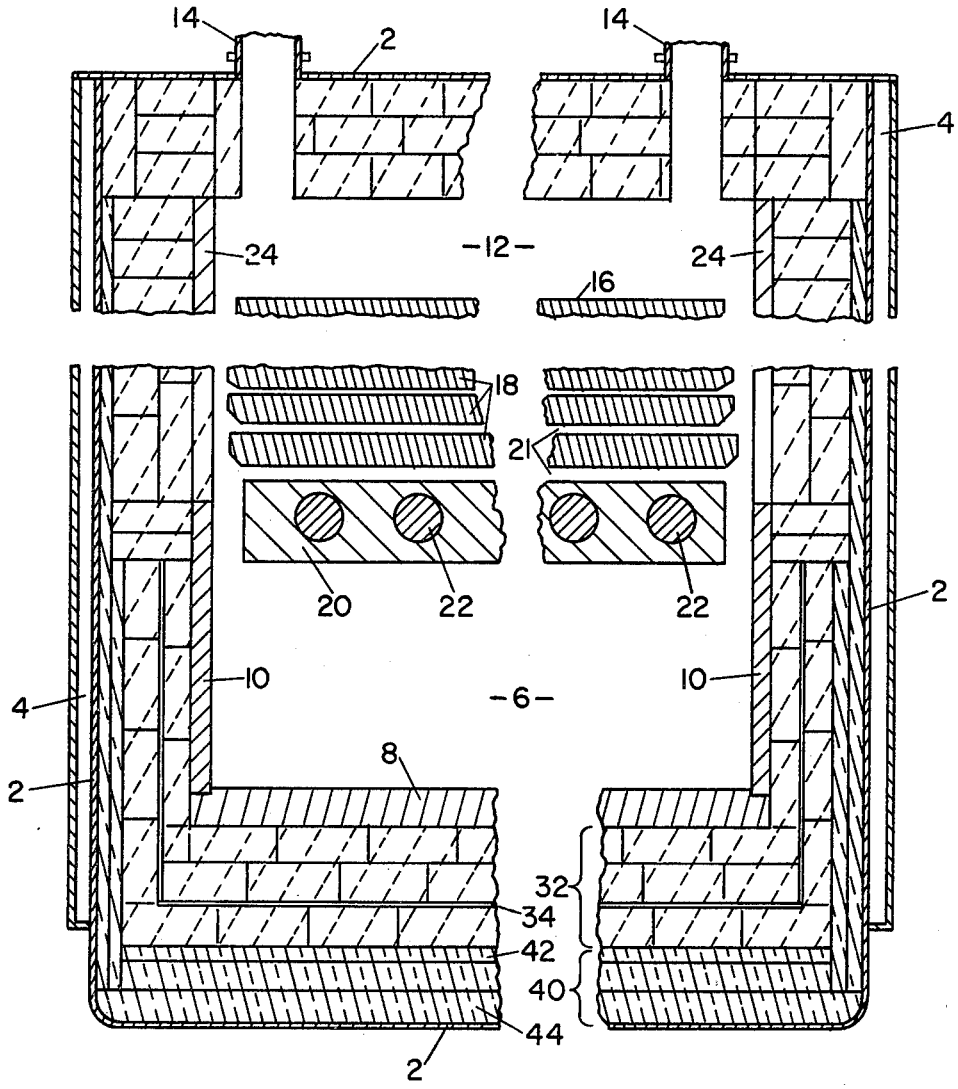
FIG. 1 is a vertical sectional view of an electrolytic cell constructed in accordance with the principles of the present invention.

Referring particularly to the drawings, FIG. 1 illustrates a preferred electrolytic furnace or cell constructed in accordance with the principles of the present invention. The cell includes a perimetric shell 2, preferably constructed of steel sheet having a thickness of at least 0.25 inch (6.35 mm). The cell structure preferably includes an outer cooling jacket 4 which surrounds a major portion of the sidewalls of the cell. During operation of the cell, coolant, such as water, flows through the jacket 4 and at such water-cooled locations withdraws heat from the cell. Though not shown in FIG. 1, a cooling jacket is usually located over the lid or cover of the cell.

The inside portion or cavity of the cell illustrated in FIG. 1 includes a sump 6 in the lower portion for collecting the molten metal produced. The floor 8 and the sides 10 of the sump are made of a carbonaceous material, preferably graphite. The cell cavity also accommodates a bath reservoir 12 in the upper section. Ports 14 extending through the lid or roof of the cell provide locations for vacuum tube removal of molten metal, for feeding light metal chloride into the bath and for venting gaseous chlorine vapor from the cell.

Also within the cavity of the cell are a plurality of plate-like electrodes including an upper terminal anode 16, a number of closely spaced bipolar electrodes 18 and a lower thermal cathode 20, all constructed of carbonaceous material, preferably graphite. The electrodes are arranged in superimposed relationship, with each electrode typically being horizontally disposed within a vertical stack, defining a series of interelectrode spaces therebetween. A plurality of vertical stacks may be employed within the same cell cavity. A plurality of collector bars 22 are inserted into the lower terminal cathode 20 to serve as negative current leads. Similarly, a plurality of electrode bars, not shown, are inserted into the upper terminal anode 16.

In the operation of the cell illustrated in FIG. 1, a bath consisting of, for example, sodium chloride (NaCl), lithium chloride (LiCl), aluminum chloride ($AlCl_3$) and magnesium chloride ($MgCl_2$) is maintained in a molten state at a temperature above the melting temperature of the aluminum being produced of 660° C. The bath is particularly circulated within the cell, such as described in Haupin U.S. Pat. No. 3,755,099 and LaCamera et al U.S. Patent No. 4,110,178. During circulation of the bath through the interelectrode spaces 21, chlorine is produced on the anode surfaces, and aluminum is produced on the cathode surfaces. The sweeping action of the bath continuously removes these constituents from their respective surfaces whereupon the heavier molten aluminum accumulates in the sump 6 of the cell.

Figure 2:
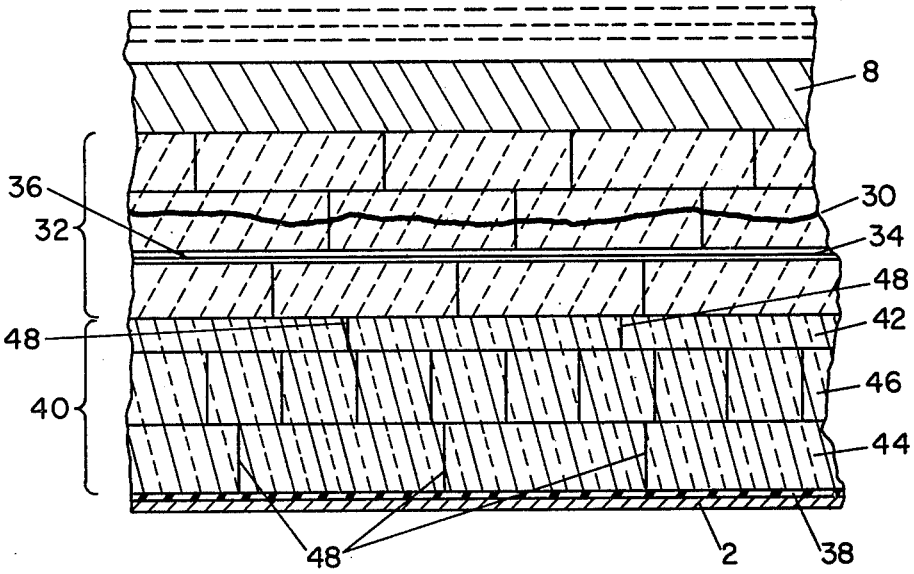
FIG. 2 is a sectional view of a portion of the lined floor of the electrolytic cell illustrated in FIG. 1.

The present invention is particularly directed to an improved lining for, at least, the air cooled walls usually located at the bottom portion of an electrolytic cell such as that illustrated in FIG. 1 and generally described above. The inner surface of the lining defines the inside portion or cavity of the cell. The lining extends outwardly therefrom to the perimetric shell 2 of the cell. Referring to FIGS. 1 and 2, the cell wall structure generally includes the perimetric shell 2, an insulative coating 38 on the inside surface of the shell 2, and a thermal lining. The thermal lining broadly includes a layer of high-fired refractory 32 with an intermediate layer of material 36 impenetrable by molten aluminum therein, and at least one layer of insulative glass refractory 40. The cell wall structure is more particularly described below.

The coating 38 applied on the inside surface of the shell electrically isolates the bath from the shell. If the molten salt bath contacts the steel shell, chlorine can be produced at anodic locations which could decompose the steel. If the steel is perforated along the side walls, coolant may enter the cell cavity and react violently with the molten bath. At cathodic locations where the bath contacts the shell 2, metal could be produced which could coalesce inwardly and eventually short-circuit at least a portion of the cell.

Russell et al U.S. Patent No. 4,140,595, teaches the use of rubber or plastic as an electric insulator on the inside surface of the metal shell 2 of a cell. Representative materials include natural plastics, such as asphalt, and synthetic plastics, such as polytetrafluoroethylene, silicone resins and epoxy resins. Mica is also an effective insulator although its cost is relatively high. It has been found that a multicoat layer of high temperature epoxy, such as ZA440 thermopoxy paint of the National Electric Coil Company, used primarily by the electrical industry, having a total thickness of, such as, at least one-eighth inch (3.175 mm) provides a continuous, corrosion resistant, electrically insulating liner for the metal shell 2.

The only drawback to the use of electrically insulative coatings is that, to date, all such coatings are able to prevent molten salt penetration therethrough only when the temperature of the salt bath at such location is relatively low, such as 120° C. or below. The temperature at which the insulative coating 38 is impenetrable by molten salt is referred to herein as the upper temperature limit. Considering a bath temperature in the neighborhood of approximately 700°–750° C., it can readily be appreciated that the heat flow from the cell cavity to the insulative coating 38 must be controlled and maintained throughout the campaign of the cell lining. The upper temperature limit of the insulative material is a primary constraint in balancing the thermal circuit through the lining of the electrolytic cell.

At least along the lower innermost portion of the cell is a sump 6 comprised of a carbonaceous material, preferably graphite. Since molten aluminum collects in the sump 6, a material must be provided that resists penetration by the molten metal. Thus, carbonaceous materials, such as graphite, are usually employed as sump walls. Precautions should be taken to insure that the graphite box or sump 6 is constructed with few, if any, seams therein because molten aluminum tends to pass through such interstices. The minimum thickness of the graphite box should be such that mechanical stability is retained under the cell operating conditions.

Although the carbonaceous sump 6 retains the molten metal therein, the molten salts in the bath readily pass therethrough uninhibited. However, molten salt penetration through the graphite sump or through the graphite electrodes has no detrimental effect on the material's resistance to molten metal penetration.

As discussed in Jacobs U.S. Pat. No. 3,745,106, an inner graphite layer 24 may also be provided around and above the bath reservoir area 12 of an electrolytic cell. Such inner graphite layer 24 provides protection against the corrosive influence of the bath and the chlorine gas produced by the operation of the cell. When such inner graphite layers are utilized, the graphite must not contact the cell lid or other surfaces or short circuiting may result.

Between the insulative coating 38 on the metal shell 2 and the inside wall of the cell, which, at least in the bottom portion of the cell, where bath constituent penetration is concentrated, is defined by the graphite sump walls 8 and 10, is a thermal lining. The thermal lining must be of sufficient thickness that heat flow therethrough is uniformly maintained such that the insulative coating is not exposed to temperatures above the upper temperature limit. In other words, a certain amount of bath material and eutectic materials formed therewith penetrate the thermal lining, pass through interstices and cracks in the lining and approach the metal shell 2. Such penetration of bath material into the refractory floor of a cell is driven primarily by the force of gravity. The heat inside the cell must be sufficient to maintain such bath materials in a molten state. But, as these materials pass through the lining, heat is lost, and the substantial majority of the materials tend to freeze within the lining. As shown in FIG. 2, which is a section of the lined cell floor, a substantially uniform salt freeze line 30 is established within the cell lining. The freeze line 30 is located at a depth at which the majority of the molten salt is exposed to its solidus temperature. Once such line 30 is established, it does not deviate appreciably therefrom provided the cell operating conditions, in terms of bath constituency and bath temperature, remain relatively constant. The salt freeze 30 also acts as a partial barrier or inhibitor to molten metal penetration through the lining. It will be understood, however, that although a freeze line 30 is established, molten materials, especially the newly formed eutectics, may penetrate beyond such barrier.

Those skilled in the art will understand the various design parameters that must be confronted in constructing a thermal lining for an electrolytic cell. For example, the molten salt bath in the cell tends to penetrate most refractory materials, especially at the high cell operating temperatures. Rather than developing a material that is impermeable to molten salts at such high temperatures, it has been found economically feasible and structurally reliable to accommodate and control such penetration. However, when accommodating penetration of molten salt, a refractory material must be chosen that is not chemically corrosive by the particular salt and is not a contaminant to the bath.

Also, controlling heat flow depends upon the thermal conductivity of the particular material being used. Use of refractory materials having relatively high thermal conductivities requires considerable cell wall thickness in order to reduce the wall temperature at the insulative coating 38 to that which is required, such as approximately 120° C. or below. Using water cooling jackets 4 or the like outside the metal shell 2 may assist in accelerating heat flow and permit the use of materials having high thermal conductivities. However, in the air cooled lining areas which are not conducive to cooling jackets, such as the lower portion of the cell walls and the cell floor, it is impractical to use such materials with high thermal conductivities. With regard to auxiliary cooling, it should also be noted that the cell cavity must not be cooled, by convection, below the melting temperature of the aluminum being produced or the metal could detrimentally solidify within the sump of the cell.

Further complicating the design parameters is the fact that a molten salt penetrated refractory has a different thermal conductivity, usually higher, than that of the same refractory when not penetrated by molten salt. This phenomenon explains the importance of maintaining a substantially uniform freeze line within the cell lining throughout the campaign of a cell.

Also, although the graphite walls 8 and 10 of the sump retain the molten aluminum therein, a small amount of molten aluminum may pass through seams or cracks therein and flow toward the metal shell 2. It is desirable to stop the flow of penetrating metal within the thermal lining to assure uniformity in heat flow patterns and prevent molten metal attack of salt resistant refractories used in the outer peripheral layers of the lining.

The thermal lining of the present invention employs materials particularly arranged and constructed to meet all of the above design parameters. In particular, a thermal balance is found for the lining when cell operation is initiated, and the thermal balance is uniformly maintained throughout the campaign of the cell because penetration of salt and metal is controlled and because the lining does not degrade. Since the lining of the present invention does not degrade the cell does not have to be designed with walls thicker than necessary for initial operation. Previously, the cell wall depth was overcompensated with a safety factor adequate to permit degradation thereof. In such instances, when the amount of degradation proceeded beyond the overcompensation point, the metal pool in the sump of the cell would not be kept molten. Also, with such linings, heat flow, thermal conductivities, freeze lines and thermal balance were constantly changing and were accordingly reflected in inefficient electrolysis. Therefore, the lining of this invention provides a significantly increased lining life while maintaining a contolled, uniform heat flow through the cell walls which insures that the metal in the sump is molten and results in the economical and efficient operation of a chloride electrolysis cell.

In accomplishing the objectives of the present invention, the thermal lining should include an inner layer of high-fired refractory 32 which is penetrable by the molten salt. High-fired refractories include those materials that have a dense, glass-type finish. The temperature at which the refractory must be fired varies with brick composition. Although other materials are comprehended, a preferred material for the inner layer of high-fired refractory is Varnon BF, a high-fired, superduty, fireclay brick available from Harbison-Walker Refractories, having the following approximate chemical analysis:

| | |
|---|---|
| Silica ($SiO_2$) | 52.7% |
| Alumina ($Al_2O_3$) | 42.0 |
| Titania ($TiO_2$) | 2.2 |
| Iron oxide ($Fe_2O_3$) | 1.2 |
| Lime (CaO) | 0.3 |
| Magnesia (MgO) | 0.4 |
| Alkalies ($Na_2O + K_2O + Li_2O$) | 1.2 |

The inner layer of high-fired refractory 32 is penetrable by the molten salt in the electrolytic bath, but the refractory resists chemical corrosion by such penetration. Bricks that are too high in silica, for example, such as over 70% by weight, have a tendency to degrade and cause silicon contamination in the aluminum being produced.

This inner layer 32 should be of sufficient thickness to insure that a substantially uniform salt freeze line 30 is located therein. Because of brick manufacturing techniques, it may be necessary to provide a plurality of layers of high-fired refractory having a certain thermal conductivity in order to insure the maintenance of the salt freeze line 30. In the sectional lining shown in FIG. 2, three courses of high-fired refractory brick were used for the inner layer 32.

It has been found that a substantially uniform salt freeze lining is established in the floor of a cell operated at a bath temperature of approximately 700° C., at a depth of approximately six inches (152.4 mm) below the sump 6 when using Varnon BF superduty fireclay brick in such area of an electrolytic cell as described above. The typical thermal conductivity for the inner layer of high-fired refractory is from approximately 7 to 12 BTU/hr/ft$^2$/°F./in. To insure that the salt freeze line is located within this inner layer 32 additional refractory thickness should be provided for this layer. Accordingly, in the preferred embodiment, a 12-inch thick layer of Varnon BF brick is used for the inner layer 32.

Figure 3:
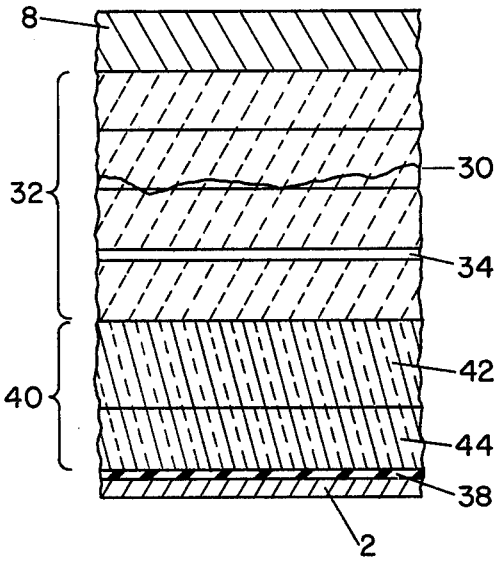
FIG. 3 is a sectional view of an alternative portion of a lined floor of an electrolytic cell.
Figure 4:
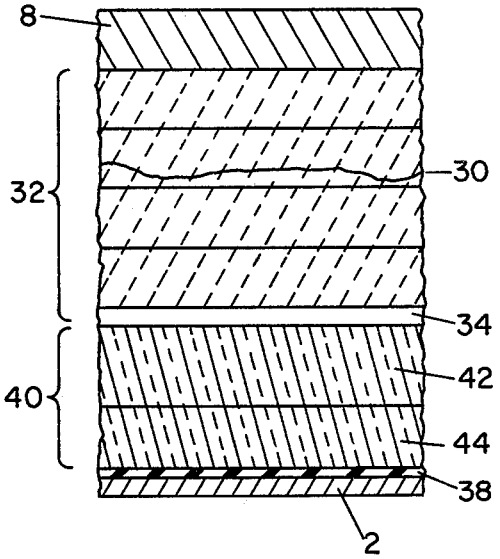
FIG. 4 is a sectional view of an alternative portion of a lined floor of an electrolytic cell.

Within the inner layer 32 but outside the perimeter of the salt freeze line 30 is provided a layer 34 of material that is impenetrable by molten aluminum. This impenetrable material is used to insure that substantially all of the molten aluminum that penetrates the graphite liner 8, and is not inhibited within the salt penetrated portion of the high-fired refractory layer 32, is prevented from passing beyond this layer of material 34 in the direction of the metal shell 2. Such impenetrable layer 34 should be provided in the lower portions, i.e. the bottom of the side walls and the floor of the electrolytic cell about the sump area 6 where the substantial majority of the molten aluminum is accumulated. Any material that is not penetrated by molten aluminum may be utilized including but not limited to carbon felt, glass cloth, such as stabilized zirconia cloth, or graphite cloth of sufficient thickness to provide mechanical stability. Preferably, multiple layers of carbon felt 34, a fabric of matted carbon fibers, are employed between the courses of Varnon BF brick, as shown in FIGS. 2 and 3. It will be understood that the carbon felt 34 may alternatively be provided between the inner layer of refractory 32 and the outer layer 40 of the lining at a location outside the freeze line 30, as shown in FIG. 4. The felt should be laid such that the seams 36 in the adjacent layers of felt are remote from one another. It will be understood that although the carbon felt may be impenetrable by molten aluminum, the seams may provide locations through which the molten metal could seep. For this reason, isolation of seams is important. Preferably, the carbon felt is compressed from a natural thickness of about one-half inch (12.7 mm) to a thickness of about one-quarter inch (6.35 mm). Compression increases the density of the cloth layer, further insuring impenetrability by molten aluminum and maintains the required mechanical stability in the lining. Also, the layer or layers of carbon felt should not extend beyond the cathode area of the cell. Use above the cathode would provide a cell-shorting path through which current could flow.

It will be understood by those skilled in the art that the metal impenetrable layer 34 may be fully permeable to molten salts. Penetration through this layer 34 by molten salt does not reduce the ability of the material to stop the penetration of molten aluminum.

The graphite liner 8 and 10 in the sump 6 of the cell contains the substantial majority of molten aluminum therein. The layer 34 within the high-fired refractory 32 and outside the salt freeze line prevents any molten metal that is not contained by the graphite liner 8 and 10 from penetrating further into the lining. Such layer must be located outside the freeze line to take advantage of the inhibiting effect that the salt penetrated refractory 32 has on the penetrating molten metal. The majority of the penetrating molten salt from the bath is contained within the high-fired refractory layer 32 along the above-described freeze line 30. However, a certain amount of molten salt and eutectics formed therefrom penetrate beyond the freeze line 30. Therefore, a lining material must be employed, at least in the lower portions of the cell where auxiliary cooling is not practical, outside the periphery of the high-fired refractory that either stops further salt penetration or reduces the temperature thereof to that at which the insulative coating 38 on the metal shell 2 is impermeable by the molten salt.

Thus, in the preferred lining illustrated in FIG. 2, the thickness of the inner layer of high-fired refractory 32 is sufficient, not only to locate the freeze line 30 therein, but also to reduce the lining temperature to that at which the first glass layer 42 is fully impervious to molten salt. By utilizing Foamsil-12, a product of Pittsburgh Corning Corporation, for such first glass layer 42, the impermeable temperature limit at such location may be as high as 700° C. Such first glass layer 42 is preferably relatively thin; ideally the thickness is that adequate to retain structural integrity. Since the glass layer is impermeable by molten salt, the bulk of the temperature drop through the lining is experienced at this location. This results in improved control of heat loss through the cell lining. Outside the first glass layer 42 may be a second glass layer 44. The second glass layer 44 is impervious to molten salt at a temperature lower than that of the first glass layer 42. By utilizing Foamsil-28, also a product of Pittsburgh Corning Corporation, for such second glass layer 44, the impermeable temperature limit at such location is about 427° C. Therefore, between such multiple layers of insulating glass refractory 42 and 44, there may have to be inserted a layer of insulating firebrick 46 of sufficient thickness to reduce the heat flow therebetween to a temperature less than the impermeable temperature limit of the adjacent outer layer. When necessary or desired, a preferred intermediate firebrick is a high alumina JM-28 insulating firebrick available from Johns-Manville Corporation.

The outer layer 40 of the lining of the present invention blends temperature reduction with salt impenetrability in the cell wall between the inner layer 32 of high-fired refractory and the insulative coating 38. Certain foamed glass refractories are fully impermeable to molten salt penetration at elevated temperatures. Preferred materials to be used in the outer layer 40 of the lining of an electrolysis cell include borosilicate and aluminoborosilicate glass foams. Exemplary materials include Foamsil-12 and Foamsil-28 that are totally impervious to molten salts of the group normally consisting of NaCl, LiCl, $AlCl_3$, $LiAlCl_4$ and $NaAlCl_4$ at temperatures of 700° C. (1292° F.) and 427° C. (800° F.), respectively. These foamed glass materials retain structural integrity at such elevated temperatures under loads as high as about 138 kPa (20 psi). Further, these glass foams do not experience an adverse amount of creep, or nominal deformation, at such temperatures and pressures over an extended period of time.

The borosilicate and alumino-borosilicate glass foams of the lining of the present invention are not only impervious to molten salt penetration, but also provide thermal insulation for the electrolytic cell. However, since the cost of such foamed glass materials is relatively high, it may be desirable to utilize thin layers thereof and separate such layers with thicker layers of a less expensive insulating firebrick.

It will be understood by those skilled in the art that although the borosilicate and alumino-borosilicate glass foams are totally impervious to molten salts, a portion of the molten salts and eutectics may pass through the interstices 48 or seams between adjacent glass bricks and proceed toward the metal shell 2. However, the entire thermal lining including the outer layer 40 is constructed such that the heat flow therethrough is uniformly maintained such that the insulative coating is not exposed to temperatures above which molten salts could penetrate therethrough.

Numerous modifications can be made in the particular arrangement and combination of materials of the lining described herein without departing from the scope of this invention, which, inter alia, requires the maintenance of a salt freeze line within an inner layer of high-fired refractory, a layer of material impenetrable by molten aluminum inside the inner layer but outside the freeze line, at least one layer of foamed glass refractory outside the inner layer and a total lining thickness sufficient to reduce heat flow to that which an insulative coating inside the metal shell is able to withstand.

What is claimed is:

1. In a cell for producing aluminum by the electrolysis of aluminum chloride in a bath of aluminum chloride dissolved in at least one molten salt of higher electrodecomposition potential than aluminum chloride, said cell including at least two opposed electrodes having interelectrode space therebetween, a cell lining comprising:

(a) a perimetric metal shell around the cell;

(b) a continuous, electrically insulative coating on the inside surfaces of the shell, said coating having an upper temperature limit at which said coating is impenetrable by said molten salt from said bath and eutectics formed therefrom;

(c) a thermal lining within the coated shell of sufficient thickness that heat flow therethrough is uniformly maintained such that the insulative coating is not exposed to temperatures above said upper temperatures limit, comprising:

(1) an inner layer of high-fired refractory, penetrable by said molten salt, and resistant to chemical corrosion by said penetration, said inner layer of sufficient thickness that a substantially uniform salt freeze line is located therein, (2) intermediate said inner layer and outside said freeze line, a layer of material impenetrable by molten aluminum, (3) around and adjacent said inner layer, at least one layer of insulative glass refractory; and (d) a perimetric carbonaceous lining along the lower, interior portions of the cell, adjacent the inner layer of high-fired refractory, for containing the produced molten aluminum therein.

2. A cell lining as set forth in claim 1 wherein the perimetric metal shell is steel having a thickness of at least 0.25 inch (6.35 mm).

3. A cell lining as set forth in claim 1 wherein the electrically insulative coating is a synthetic plastic selected from the group consisting of epoxy resins, silicone resins, and polytetrafluoroethylene.

4. A cell lining as set forth in claim 3 wherein the upper temperature limit of the electrically insulative coating is at least 100° C.

5. A cell lining as set forth in claim 1 wherein the inner layer of high-fired refractory has a thermal conductivity of from approximately 7 to 12 BTU/hr/ft$^2$/°F./in.

6. A cell lining as set forth in claim 1 wherein the material impenetrable by molten aluminum is selected from the group consisting of carbon felt, stabilized zirconia cloth and graphite cloth.

7. A cell lining as set forth in claim 1 wherein the insulating glass refractory comprises a first layer of refractory foam glass fully impermeable to molten salts at temperatures less than about 700° C., and a second layer of refractory foam glass outside said first layer, fully impermeable to molten salts at temperatures less than about 425° C.

8. A cell lining as set forth in claim 7 wherein the first and second layers are separated by a layer of insulating firebrick of sufficient thickness to reduce the heat flow therebetween to a temperature less than about 425° C.

9. In a cell for producing aluminum by the electrolysis of aluminum chloride in a 660° to 730° C. bath consisting essentially of aluminum chloride dissolved in molten salts of the group consisting of sodium chloride, lithium chloride, aluminum chloride and sodium aluminum chloride, said cell including at least two opposed electrodes having interelectrode space therebetween, a cell lining for the lower air cooled portions of said cell comprising:

(a) a perimetric steel shell around the cell having a thickness of at least 6.35 mm;

(b) a continuous, electrically insulative epoxy coating on the inside surfaces of the shell, said epoxy coating having an upper temperature limit of at least 100° C.;

(c) a thermal lining within the coating shell of sufficient thickness that the temperature of the lining is less than the upper temperature limit at the location of the epoxy coating, comprising:

(1) an inner layer of high-fired refractory, penetrable by said molten salts, and resistant to chemical corrosion by said penetration, said inner layer of sufficient thickness that a salt freeze line is located therein, said inner layer having a thermal conductivity of approximately 7 to 12 BTU/hr/ft$^2$/°F./in., (2) intermediate said inner layer and outside said freeze line, at least one layer of a cloth material impenetrable by molten aluminum selected from the group consisting of carbon felt, zirconia cloth and graphite cloth, said material having a compressed thickness of at least 6.35 mm, (3) outside said inner layer, multiple layers of insulating glass refractory, consisting of:

(i) a first layer of insulating glass refractory fully impermeable to said molten salts at temperatures less than about 700° C. at pressures less than 117 kPa, without experiencing creep, (ii) a second layer of insulating glass refractory, outside said first layer, fully impermeable to said molten salts at temperatures less than about 425° C. at pressures less than 103 kPa without creep; and (d) a perimetric graphite lining along the lower, interior portions of the cell, adjacent the inner layer of high-fired refractory, for containing the produced molten aluminum therein.

10. In a cell for producing aluminum by the electrolysis of aluminum chloride in a 660° to 730° C. bath consisting essentially of aluminum chloride dissolved in molten salts of the group consisting of sodium chloride, lithium chloride, aluminum chloride and sodium aluminum chloride, said cell including at least two opposed electrodes having interelectrode space therebetween, a cell lining for the lower air cooled portions of said cell comprising:

(a) a perimetric steel shell around the cell having a thickness of at least 6.35 mm;

(b) a continuous, electrically insulative epoxy coating on the inside surfaces of the shell, said epoxy coating having an upper temperature limit of at least 100° C.;

(c) a thermal lining within the coated shell of sufficient thickness that the temperature of the lining is less than the upper temperature limit at the location of the epoxy coating, comprising:

(1) an inner layer of high-fired refractory, penetrable by said molten salts, and resistant to chemical corrosion by said penetration, said inner layer of sufficient thickness that a salt freeze line is located therein, said inner layer having a thermal conductivity of approximately 7 to 12 BTU/hr/ft$^2$/°F./in., (2) intermediate said inner layer and outside said freeze line, two adjacent layers of a cloth material impenetrable by molten aluminum selected from the group consisting of carbon felt, zirconia cloth and graphite cloth, said material having a compressed thickness of at least 6.35 mm, (3) outside said inner layer, multiple layers of insulating glass refractory, consisting of:

(i) a first layer of insulating glass refractory fully impermeable to said molten salts at temperatures less than about 700° C. at pressures less than 117 kPa, without experiencing creep, (ii) a second layer of insulating glass refractory, outside said first layer, fully impermeable to said molten salts at temperatures less than about 425° C. at pressures less than 103 kPa without creep, (4) between said multiple layers of insulating glass refractory, a layer of insulating firebrick of sufficient thickness to reduce the heat flow therebetween to a temperature less than the impermeable temperature limit of the adjacent outer layer; and (d) a perimetric graphite lining along the lower, interior portions of the cell, adjacent the inner layer of high-fired refractory, for containing the produced molten aluminum therein.

11. A cell as set forth in claims 9 or 10 wherein the layers of insulating glass refractory are selected from the group consisting of borosilicate glass foam, aluminoborosilicate glass foam and combinations thereof.

* * * * *